US006367853B1

(12) United States Patent
Briggs

(10) Patent No.: US 6,367,853 B1
(45) Date of Patent: Apr. 9, 2002

(54) UNIVERSAL LOCK HANDLE ASSEMBLY FOR CASEMENT WINDOWS

(75) Inventor: Jeffrey Mark Briggs, Madison, CT (US)

(73) Assignee: Roto Frank of America, Inc., Essex, CT (US)

( * ) Notice: Subject to any disclaimer, the term of this patent is extended or adjusted under 35 U.S.C. 154(b) by 0 days.

(21) Appl. No.: 09/532,975

(22) Filed: Mar. 22, 2000

(51) Int. Cl.[7] ..... E05B 3/00; E05B 55/00; E05C 7/00; G05G 1/00

(52) U.S. Cl. ..... 292/336.3; 292/35; 292/DIG. 57; 49/449; 74/544

(58) Field of Search ..... 292/9, 336.3, 35, 292/36, 40, 139, DIG. 38, DIG. 57, 158; 49/183, 184, 449; 74/525, 544, 546

(56) References Cited

U.S. PATENT DOCUMENTS

| | | | | |
|---|---|---|---|---|
| 4,059,298 A | | 11/1977 | Van Klompenburg | |
| 4,429,910 A | | 2/1984 | Anderson | |
| 4,621,847 A | | 11/1986 | Paulson et al. | |
| 4,828,299 A | * | 5/1989 | Poe | 292/139 |
| 4,991,886 A | | 2/1991 | Nolte et al. | |
| 5,118,145 A | | 6/1992 | Tucker | |
| 5,318,333 A | | 6/1994 | Dreifert | |
| 5,370,428 A | | 12/1994 | Dreifert et al. | |
| 5,373,635 A | * | 12/1994 | Nonaka et al. | 29/898.1 |
| D388,689 S | | 1/1998 | Bauman et al. | |
| D390,445 S | | 2/1998 | Johnson et al. | |
| 5,741,031 A | | 4/1998 | Bauman et al. | |
| 5,778,602 A | | 7/1998 | Johnson et al. | |
| 5,829,802 A | * | 11/1998 | Anderson et al. | 292/336.3 |
| 5,839,767 A | | 11/1998 | Piltingsrud | |
| 6,109,668 A | * | 8/2000 | Demarco | 292/161 |
| D440,143 S | * | 4/2001 | Minter et al. | D8/338 |

OTHER PUBLICATIONS

Brochure entitled: "Casement Operator and Multi Point Locking Bar for Vinyl Aluminum Casement Windows" by Wilhelm Weidtmann GmbH & Co. KG Baubeschläge.

* cited by examiner

*Primary Examiner*—Anthony Knight
*Assistant Examiner*—Vishal Patel
(74) *Attorney, Agent, or Firm*—Marshall, Gerstein, & Borun

(57) ABSTRACT

A universal lock handle assembly for multi-point casement windows is provided. The lock handle assembly includes an escutcheon that is mounted to the inside surface of the window frame. The escutcheon includes a slot for receiving a handle. The handle includes a grip portion that is connected to a mid-section which, in turn, is connected to a forked end. The mid-section of the handle is pivotally connected to the escutcheon below or exterior to the inside surface of the window frame. The forked end of the handle includes two spaced-apart legs that define an open slot for slidably receiving a slider. The slider, in turn, is pivotally connected to a tiebar. The slider enables the overall length of the handle to be variable thereby enabling the distance between the tiebar and the escutcheon or the inside surface of the window frame to be variable as well.

20 Claims, 2 Drawing Sheets

UNIVERSAL LOCK HANDLE ASSEMBLY FOR CASEMENT WINDOWS

FIELD OF THE INVENTION

The present invention relates generally to locking mechanisms for casement windows. More specifically, the present invention relates to an improved lock handle assembly or actuator assembly for a multi-point casement window lock. Still more specifically, the present invention relates to an improved lock handle assembly or actuator assembly for installation on vinyl casement windows of a wide variety of sizes and configurations.

BACKGROUND OF THE INVENTION

Casement windows are known. In the past, the locking of a casement window sash to a window frame has been problematic because casement window sashes have a tendency to warp with age and therefore it can be difficult to hold an entire side edge of a sash against a frame for locking purposes. Further, casement window operators typically apply the closing force to only one end of the casement window sash, e.g. the bottom end, and therefore there is a tendency for one end of the sash to engage the frame before the opposing end of the sash. As a result, the side edge, of the sash that is to be locked against the frame does not engage the frame all at once thereby making the sash difficult to lock.

To overcome these problems, tie bars have been employed along the edge of the frame to lock the sash against the frame. The tie bars typically include a plurality of rollers mounted on the tie bar that engage ramped keepers spaced along the edge of the window sash. To overcome the warping problem discussed above, the rollers and keepers are appropriately spaced so that the rollers engage the keepers in a sequential manner, typically, starting from the bottom of the sash and ending with the top of the sash. As a result, the bottom of the sash is locked first and the sequential interaction of the middle and top rollers with the middle and top keepers respectively results in the middle and top portions of the sash being pulled against the frame and locked shut.

However, due to the success and wide acceptance of such sequential locking mechanisms, these locking mechanisms are used in a variety of different windows having window frames and window sashes with a wide variety of dimensions and configurations. As a result, the spacing between the handle or actuator from the tie bar can vary depending upon the manufacturer and window style. Some locks are usable only with certain styles of windows and other window styles require that locks be specifically manufactured for that style. As a result, manufacturing costs can be quite high and the wide variety of locks that are required requires builders to maintain undesirably large inventories of such locks.

Further, aesthetic demands have required the handle and escutcheon to have a relatively low profile on the inside surface of the frame. Escutcheons that protrude outwardly from the inside surface of the frame more than ¾" are not preferred by consumers and interior designers because they present a prominent appearance on the inside surface of the frame. Instead, consumers and interior designers prefer a low profile escutcheon/handle combination that attracts little notice.

Therefore, there is a need for an improved lock handle assembly for casement windows that can be utilized on a variety of window designs and that provides a low profile for the escutcheon and handle.

SUMMARY OF THE INVENTION

The present invention provides a lock handle assembly that satisfies both of the aforenoted needs. Specifically, the lock handle assembly of the present invention is readily adaptable to a wide variety of window sizes and styles due to its use of a slider or slidable connecting link between the tie bar and the lock handle mechanism. Further, the lock handle assembly of the present invention includes an escutcheon that has a low profile on the inside surface of the window frame because the axis of rotation of the handle assembly is disposed below the inside surface of the window.

Specifically, in an embodiment, the present invention provides a lock handle assembly for mounting to a multi-point casement window frame having an inside surface. The lock handle assembly comprises an escutcheon for mounting to the inside surface of the frame. The escutcheon comprises a slot for receiving a handle. The handle, in turn, comprises a grip that is connected to a mid-section which, in turn, is connected to a forked end. The mid-section being disposed between the grip and the forked end. The mid-section of the handle is pivotally connected to the escutcheon. The forked end of the handle comprises two spaced-apart legs that define an open slot for slidably receiving a slider member or slider. The slider is pivotally connected to a tiebar.

In an embodiment, the mid-section of the handle is connected to the escutcheon by a shaft that has an axis that extends transversely through the mid-section.

In an embodiment, the mid-section of the handle is connected to an escutcheon by a shaft that has an axis that extends transversely outward from the mid-section of the handle.

In an embodiment, the mid-section of the handle is connected to the escutcheon by a shaft that has an axis that extends transversely through the escutcheon.

In an embodiment, the mid-section of the handle is connected to the escutcheon by a shaft that extends transversely into holes disposed in opposing sides of the escutcheon.

In an embodiment, the shaft extends transversely with respect to the outer side of the escutcheon, or the portion of the escutcheon that is disposed within the casement window frame or exterior to the inside surface of the casement window frame.

In an embodiment, the legs of the forked end of the handle are lined with a plastic material. The slider rides on the plastic material. The plastic material provides corrosion resistance and smooth operation.

In an embodiment, the slider comprises two edges whereby each edge faces one leg of the forked end. Each edge of the slider is lined with a plastic material that engages its respective leg of the forked end of the handle.

In an embodiment, the legs of the forked end of the handle each comprise a groove. The groove of each leg accommodates a liner material. The slider comprises two edges whereby each edge of the slider faces one of the legs of the forked end of the handle. Each edge of the slider comprises a groove for slidably receiving the liner material of one of the legs of the forked end of the handle.

In an embodiment, each leg of the forked end of the handle comprises a groove. The slider further comprises two edges whereby each edge of the slider faces a groove of one of the legs of the forked end of the handle. Each edge of the slider comprises a groove and the grooves of the slider each accommodate liner material which is slidably received in the groove of one of the legs of the forked end of the handle.

Other objects and advantages of the present invention will become apparent to those skilled in the art upon reviewing the following detailed description, drawings and appended claims.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are riot necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
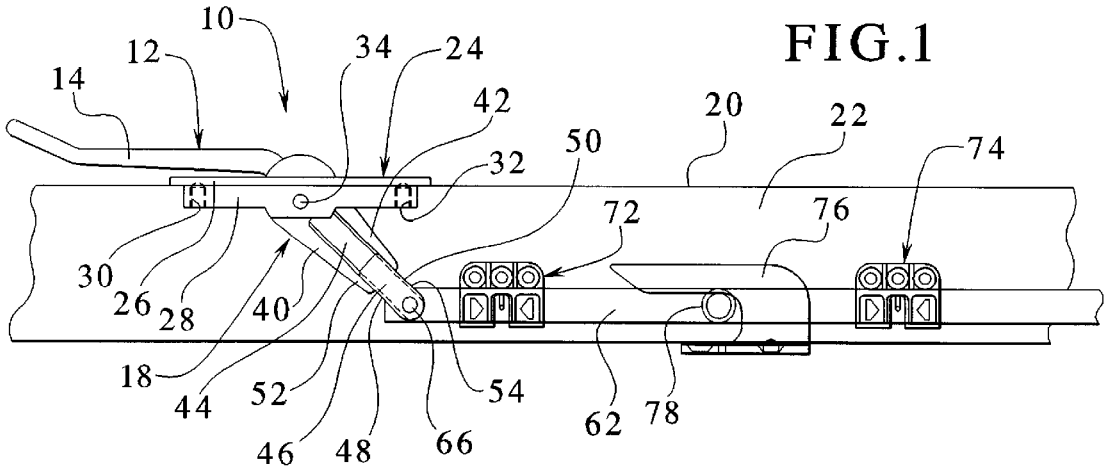
FIG. 1 is a side view of the lock handle assembly made in accordance with the present invention connected to a tiebar and further illustrating a lock handle assembly in the locked position.
Figure 2:
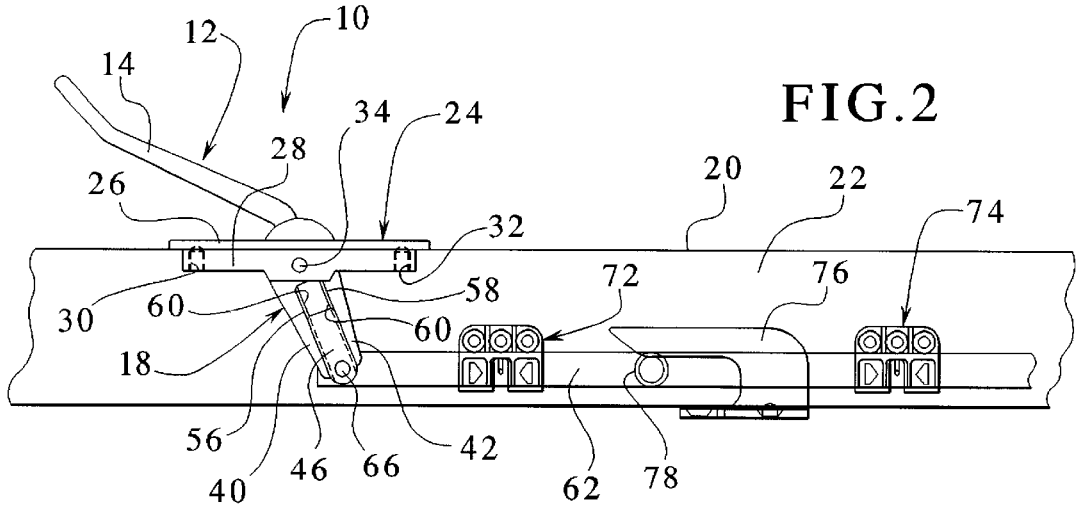
FIG. 2 is a side view of the lock handle assembly shown in FIG. 1 as it is rotated towards an unlock position.
Figure 3:
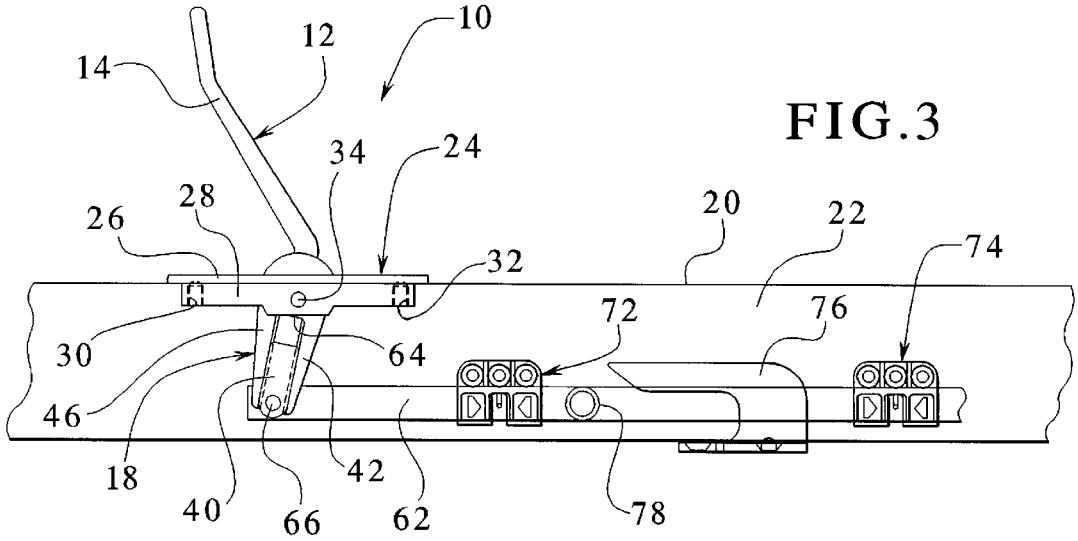
FIG. 3 is a side view of the lock handle assembly shown in FIGS. 1 and 2 after it has been rotated to the unlocked position.
Figure 4:
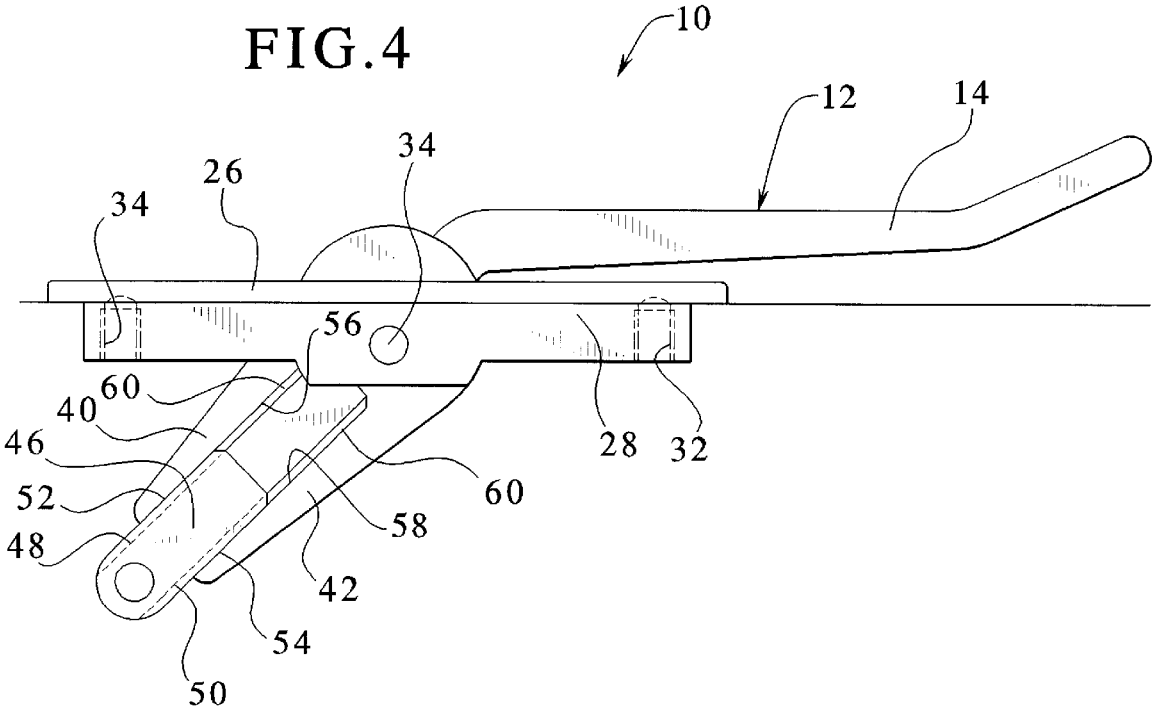
FIG. 4 is a side view of the lock handle assembly shown in FIGS. 1–3.

Turning first to FIGS. 1–3, a universal lock handle assembly 10 is shown in the locked position (FIG. 1), a middle position or a semi-locked position (FIG. 2) and an unlocked position (FIG. 3). The universal lock handle assembly 10 includes a handle 12 that includes three parts. Those three parts are the grip 14, the middle section 16 (see FIG. 5) and the forked end 18. The grip 14 is slim in configuration (see FIG. 5) which helps the handle assembly 10 assume a low profile which helps the handle assembly 10 attract little notice against the inside surface 20 of the window frame 22.

The handle 12 is connected to an escutcheon 24 which is mounted to the window frame 22. The escutcheon 24 includes a body that has an inner side 26 that lies on top of the inside surface 20 of the window frame 22 and an outer side 28 that is disposed within a recess cut into the window frame 22. Screws or other fasteners pass through the outer side 28 of the escutcheon 24 and through the openings 30, 32 to fasten the escutcheon 24 in place on the inside surface 20 of the window frame 22. In this manner, no screws or other fasteners are apparent from the inside surface 20 of the window frame 22.

The handle 12 is pivotally connected to the escutcheon 24 by way of a shaft or pin mechanism shown at 34. A variety of connection mechanisms may be employed such as a shaft or pin that passes transversely through the mid-section 16 (not shown in FIG. 1; see FIG. 5) of the handle 12 as well as the outer side 28 of the escutcheon 24 or the mid-section 16 of the handle 12 may include two outwardly protruding shafts that are received in holes or recesses disposed in the opposing sidewalls 36, 38 of the outer side 28 of the escutcheon 24 (see FIG. 5).

The forked end 18 includes two spaced-apart legs 40, 42 that define a slot 44. A slider or slide member 46 is slidably received in the slot 44.

In a preferred embodiment, the slider 46 includes grooves 48, 50 disposed in the side edges 52, 54 respectively. The side edges 56, 58 of the legs 40, 42 respectively of the forked end 18 of the handle 12 are lined with a plastic or polymer material 60. The plastic or polymer material 60 protrudes outwardly and is received in the grooves 48, 60 of the slider 46. The employment of this plastic lining 60 provides for a smooth operation and corrosion resistance.

The employment of the slider 46 renders the handle assembly 10 universal because of its ability to variably extend the length of the handle 12. Specifically, as shown in FIG. 1, the slider 46 has not yet reached the distal ends of the fork legs 40, 42. Thus, the tiebar 62 could be spaced slightly farther away from the inside surface 20 of the window frame 22 than shown in FIG. 1. Further, as shown in FIGS. 2 and 3, the slider 46 does not come close to jamming against the inside edge as the handle 12 is moved from the locked to the unlocked position. Accordingly, the tiebar 62 could be moved substantially closer to the inside surface 20 of the window frame 22. Therefore, by employing the slider 46, the inventors have found a way to create a single universal lock handle assembly 10 which enables the distance between the inside surface 20 or the mounting surface for the escutcheon 24 and the tiebar 62 to be variable.

The slider 46 is pivotally connected to the tiebar 62, preferably by a rivet 66. Another advantage of the present invention is that only a single rivet connection is required for the universal lock handle assembly as shown. Other designs require at least two rivet connections, one between a connecting link and the tiebar and another between the connecting link and the handle assembly. Thus, the universal lock handle assembly 10 of the present invention is easier to manufacture than universal lock handle assemblies known in the art.

Figure 5:
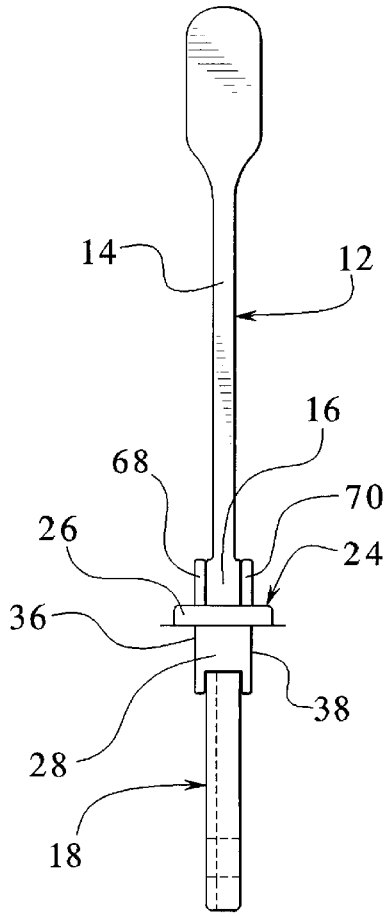
FIG. 5 is an end view of the lock handle assembly shown in FIG. 4.

Also shown in FIG. 2 is the low profile of the inner side 26 of the escutcheon 24. As shown in FIG. 5, the inner side 26 may include upwardly extending walls 68,70 which serve as guards for the mid-section 16 of the handle 12.

Also shown in FIGS. 1–3 is the employment of brackets 72, 74 for slidably retaining the tiebar 62 and a single ramped keeper 76/roller 78 combination. Typically, the brackets; 72, 74, tiebar 62 and roller 78 are mounted to the stationary window frame 22 while the keeper 76 is mounted to the moving window frame (not shown).

It will also be noted that the aforenoted plastic lining 60 may be disposed on the slider 46 as opposed to the legs 40, 42 of the forked end 18. The handle 12 can be fabricated from a unitary molded part.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A lock handle assembly comprising:

an escutcheon comprising a slot for receiving a handle, the handle comprising a grip connected to a mid-section, the mid-section being connected to forked end, the mid-section of the handle being pivotally connected to the escutcheon, the forked end comprising two spaced-apart legs that define an open slot for slidably receiving a slider, the slider being pivotally connected to a tie bar, the open slot comprising a closed proximal end and an open distal end, the slider slidably moving between the closed proximal and open distal ends during operation of the lock handle assembly.

2. The lock handle assembly of claim 1 wherein mid-section of the handle is connected to the escutcheon by a shaft having an axis that extends transversely through the mid-section.

3. The lock handle assembly of claim 1 wherein mid-section of the handle is connected to the escutcheon by a shaft having an axis that extends transversely outward from the mid-section.

4. The lock handle assembly of claim 1 wherein mid-section of the handle is connected to the escutcheon by a shaft having an axis that extends transversely through the escutcheon.

5. The lock handle assembly of claim 1 wherein mid-section of the handle is connected to the escutcheon by a shaft that extends transversely in to holes disposed in opposing sides of the escutcheon.

6. The lock handle assembly of claim 2 wherein the escutcheon comprises an inner side that faces away from an inside of the window and an outer side that extends through the inside surface of the window, the shaft extending transversely with respect to the outer side of the escutcheon.

7. The lock handle assembly of claim 1 wherein the legs of the forked end are lined with a plastic material, the slider riding on the plastic material.

8. The lock handle assembly of claim 1 wherein the slider comprised two edges, each edge facing one leg of the forked end of the handle, each edge of the slider being lined with a plastic material that engages its respective leg of the forked end of the handle.

9. The look handle assembly of claim 1 wherein the legs of the forked end each comprise a groove, the groove of each leg accommodating a liner material, the slider further comprising two edges, each edge of the slider facing one of the legs of the forked end of the handle, each edge of the slider comprising a groove for slidably receiving the liner material of one of the legs of the forked end of the handle.

10. The lock handle assembly of claim 1 wherein the legs of the forked end each comprise a groove, the slider further comprising two edges, each edge of the slider facing a groove of one of the legs of the forked end of the handle, each edge of the slider comprising a groove, the grooves of the slider each accommodating a liner material that is slidably received in the groove of one of the legs of the forked end of the handle.

11. A universal lock handle assembly for a multi-point casement window having a frame with an inside surface, the lock handle assembly comprising:

an escutcheon for mounting to the inside surface of the frame, the escutcheon comprising a body comprising an inner side facing away from the inside surface of the window and an outer side that extends through the inside surface of the window, the escutcheon further comprising a slot for receiving a handle, the handle comprising a grip connected to a mid-section, the mid-section being connected to forked end, the mid-section of the handle being pivotally connected to the escutcheon at an axis that extends transversely to the outer side of the escutcheon, the forked end comprising two spaced-apart legs that define an open slot for slidably receiving a slider, the open slot comprising a closed proximal end and an open distal end, the slider slidably moving between the closed proximal and open distal ends during operation of the lock handle assembly, the slider being pivotally connected to a tie bar.

12. The lock handle assembly of claim 11 wherein mid-section of the handle is connected to the escutcheon by a shaft that extends transversely through the mid-section.

13. The lock handle assembly of claim 11 wherein mid-section of the handle is connected to the escutcheon by a shaft that extends transversely outward from the mid-section.

14. The lock handle assembly of claim 11 wherein mid-section of the handle is connected to the escutcheon by a shaft that extends transversely through the escutcheon.

15. The lock handle assembly of claim 11 wherein mid-section of the handle is connected to the escutcheon by a shaft that extends transversely into holes disposed in opposing sides of the escutcheon.

16. The lock handle assembly of claim 11 wherein the legs of the forked end are lined with a plastic material, the slider riding on the plastic material.

17. The lock handle assembly of claim 11 wherein the slider comprised two edges, each edge of the slider facing one leg of the forked end of the handle, each edge of the slider being lined with a plastic material that engages its respective leg of the forked end of the handle.

18. The lock handle assembly of claim 11 wherein the legs of the forked end of the handle each comprise a groove, the groove of each leg accommodating a liner material, the slider further comprising two edges, each edge of the slider facing one of the legs of the forked end of the handle, each edge comprising a groove for slidably receiving the liner material of one of the legs of the forked end of the handle.

19. The lock handle assembly of claim 11 wherein the legs of the forked end each comprise a groove, the slider further comprising two edges, each edge facing a groove of one of the legs of the forked end of the handle, each edge of the slider comprising a groove, the grooves of the slider each accommodating a liner material that is slidably received in the groove of one of the legs of the forked end of the handle.

20. A universal lock handle assembly for a multi-point casement window having a frame with an inside surface, the lock handle assembly comprising:

an escutcheon for mounting to the inside surface of the frame, the escutcheon comprising a body comprising an inner side facing away from the inside surface of the window and an outer side that extends through the inside surface of the window, the escutcheon further comprising two opposing walls that define a slot for receiving a handle, the handle comprising a grip connected to a mid-section, the mid-section being connected to forked end, the mid-section of the handle being pivotally connected to the escutcheon by a shaft that extends transversely through the mid-section and at least partially through the opposing walls of the outer side of the escutcheon, the forked end of the handle comprising two spaced-apart legs that define an open slot for slidably receiving a slider, the legs of the forked end each comprise a groove, the groove of each leg accommodating a liner material, the slider further comprising two edges, each edge of the slider facing one of the legs of the forked end, each edge comprises a groove for slidably receiving the liner material of one of the legs, the open slot comprising a closed proximal end and an open distal end the slider slidably moving on the liner material and between the closed proximal and open distal ends of the slot during operation of the lock handle assembly, the slider being pivotally connected to a tie bar.

* * * * *

UNITED STATES PATENT AND TRADEMARK OFFICE
Certificate

Patent No. 6,367,853 Patented: April 9, 2002

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: John A. Chiaia, Branford; Peter Minter, Branford; and Jeffrey Mark Briggs, Madison; All of Connecticut.

Signed and Sealed this Twelfth Day of November 2002.

ANTHONY KNIGHT
*Supervisory Patent Examiner*
Art Unit 3676